US005258081A

United States Patent [19]

Peel et al.

[11] Patent Number: 5,258,081

[45] Date of Patent: Nov. 2, 1993

[54] AUXILIARY HEAT TREATMENT FOR ALUMINIUM-LITHIUM ALLOYS

[75] Inventors: Christopher J. Peel, Hampshire, England; Stanley P. Lynch, Elwood, Australia

[73] Assignee: The Secretary of State for Defence in Her Britannic Majesty's Government of the United Kingdom of Great Britain and Northern Ireland, Whitehall, United Kingdom

[21] Appl. No.: 859,696

[22] PCT Filed: Oct. 11, 1990

[86] PCT No.: PCT/GB90/01568

§ 371 Date: Jun. 11, 1992

§ 102(e) Date: Jun. 11, 1992

[87] PCT Pub. No.: WO91/05884

PCT Pub. Date: May 2, 1991

[30] Foreign Application Priority Data

Oct. 12, 1989 [GB] United Kingdom ..... 8923047

[51] Int. Cl.[5] ..... C22F 1/00

[52] U.S. Cl. ..... 148/437; 420/549

[58] Field of Search ..... 148/437; 420/549

[56] References Cited

U.S. PATENT DOCUMENTS 4,747,884 5/1988 Gayle et al. ..... 148/437
4,806,174 2/1989 Cho et al. ..... 148/437
4,844,750 7/1989 Cho et al. ..... 148/437
4,861,391 8/1989 Rioja et al. ..... 148/12.7
4,921,548 5/1990 Cho ..... 148/437
5,066,342 11/1991 Rioja et al. ..... 148/437

FOREIGN PATENT DOCUMENTS 0090583 10/1983 European Pat. Off. .

OTHER PUBLICATIONS

Aerospace, vol. 16, No. 5, May 1989, pp. 18–23 Peel et al. "The present status of the development and application of Aluminum–Lithium Alloys 8090 and 8091".

*Primary Examiner*—Upendra Roy
*Attorney, Agent, or Firm*—Nixon & Vanderhye

[57] ABSTRACT

Artificially aged aluminum-lithium alloys are given an auxiliary heat treatment at or after completion of ageing to improve short-transverse properties, particularly fracture toughness. The auxiliary heat treatment comprises heating the material steadily to a reversion temperature above the ageing temperature by at least 20° C. but not higher than 250° C., retaining the material briefly at temperature then cooling to room temperature. Typically the treatment involves heating to a reversion temperature in the range 190°–230° C. with a hold at this temperature of around 5 minutes. Boosted properties decay with extended exposure to temperatures of 60° C. and above but may be restored by reimposition of the auxiliary heat treatment.

7 Claims, 4 Drawing Sheets

SL FRACTURE TOUGHNESS, $K_Q$ (MPa√m)
34
32
30
28
26
24
22
20
18
16
14
12
10
8
1
10
100
1000
10000
TIME AT REVERSION TEMPERATURE ($t_2$) IN MINUTES
230°C
210°C
200°C
T8771 CONDITION

SL FRACTURE TOUGHNESS, KQ (MPa√m)
28
26
24
22
20
18
16
14
12
10
8
6
4
2
0
11.6
17.8
19.9
22.9
26.0
T8771
(32h at 170°C)
T8771 + 5min at 210°C
SLOW SLOW
RAPID SLOW
SLOW RAPID
RAPID RAPID
— HEATING RATE
— COOLING RATE SL FRACTURE TOUGHNESS, KQ (MPa√m)
24
22
20
18
16
14
12
10
8
6
4
2
0
11.6
17.5
21.7
22.5
T8771
T8771 + 5min at 200°C
SLOW SLOW
SLOW RAPID
RAPID RAPID
— HEATING RATE
— COOLING RATE

AUXILIARY HEAT TREATMENT FOR ALUMINIUM-LITHIUM ALLOYS

This invention relates to a particular form of heat treatment for aluminium-lithium alloys, that is those alloys based on aluminium which include lithium as a deliberate alloying addition rather than a trace impurity. Practical aluminium-lithium alloys include strengthening ingredients additional to the lithium such as copper, magnesium or zinc. The heat treatment is intended for use on such alloys in certain product forms and/or tempers to improve fracture toughness or ductility particularly in the short transverse direction. The term "short transverse direction" is a term of art applied in respect of plate or sheet material to specify the axis of cross-section through the thickness of the material and used also in respect of other product forms such as extrusions and forgings to identify a cross-grain orientation.

BACKGROUND OF THE INVENTION

Aluminium-lithium alloys based on the aluminium-lithium-copper and aluminium-lithium-copper-magnesium systems have been developed to the stage where they are currently being considered for large-scale commercial use on the next generations of civil and military aircraft. The attractiveness of such alloys as replacements for established non lithium-containing aluminium alloy lies in their reduced density and increased stiffness but widespread application of these materials in aerospace structures will be dependent upon attainment of a satisfactory combination of many properties. The aluminium-lithium-copper-magnesium alloy registered internationally under the designation 8090 provides reduced density and increased stiffness in combination with strength, fracture toughness, corrosion resistance, fatigue resistance and ease of production at a level far in advance of the first aluminium-lithium alloys. Nevertheless there remains a perceived problem with regard to current aluminium-lithium alloys in regard to low fracture toughness in the short transverse direction. It might be that a low fracture toughness in the short transverse direction. It might be that a low fracture toughness in this axis presents no real barrier to use of the alloys in normal applications because the materials will not be subjected to usage which presents a stress on the axis but it remains something of a barrier to confidence in the new materials and might conceivably affect service life in some situations. The 8090 alloy for example, when aged to yield a tensile strength of 500 MPa or more which is typical of the modern high strength aerospace 7000 series alloys in the T76 condition, can exhibit low levels of fracture toughness in the short transverse direction typically 11 or 12 MPa $(m)^{\frac{1}{2}}$ as against 18 to 20 MP $(m)^{\frac{1}{2}}$ for the 7000 material whilst fracture toughness in other orientations of the 8090 alloy is more than acceptable.

The problem or perceived problem is not new-found and various tentative explanations have been advanced previously in the prior art. It is known that fracture in the short transverse plane (whether crack growth occurs in the longitudinal direction or the transverse direction orthagonal to the applied stress) occurs along grain boundaries and is brittle in nature showing little evidence of local ductility in those materials exhibiting low short transverse fracture toughness. The tentative explanations already made in the open literature embrace the following possibilities: localisation of the plastic strain at grain boundaries; grain boundary embrittlement by traces of hydrogen or low melting point metallic elements such as sodium, potassium or calcium; and the formation of large phases at the grain boundaries containing lithium, copper and possibly magnesium. This invention provides a convenient solution to the problem and studies made in relation to the invention indicate that these previously proposed explanations do not go the root of the matter though some of them relate to phenomena which will make some degree of contribution to the problem in certain circumstances.

Those present day aluminium-lithium alloys which are produced by the ingot metallurgy route rather than rapid solidification routes, are subject to the normal processing steps used and well established in the art for other species of precipitation hardening aluminium alloys, namely: casting to ingot; homogenisation heat treatment; forming to semi-finished product or product; solution heat treatment; quenching and artificial ageing at elevated temperature. In some alloys/tempers/-products there is a cold working stage prior to the artificial ageing to secure an enhanced ageing response. The aim of the ageing treatment is to promote accelerated decomposition of the pre-existing supersaturated solid solution yielding the required strengthening precipitates.

Various artificial ageing treatments are known in the art in regard to aluminium-lithium alloys. Choice of ageing time and temperature permits ageing to peak strength, underageing, or overageing as required. Duplex ageing treatments are known, these being treatments in which the material is held at first one temperature (for the first stage of treatment) then held for a second period at a different temperature. As far as is known, those ageing treatments currently adopted for aluminium-lithium alloys aim to maintain the material in thermal equilibrium during each ageing period to promote a uniform precipitation of the strengthening phase or phases. We have found that the short transverse fracture toughness and ductility of aluminium-lithium alloys of the alunimium-lithium-copper-magnesium system can be significantly improved by imposition of an auxiliary heat treatment after ageing and our investigations of the phenomenon suggest that the auxiliary heat treatment will be effective also for other species of aluminium-lithium alloys such as alloys which contain copper but not magnesium and those alloys which contain zinc with or without copper and/or magnesium. Whilst the treatment might be expected to be of benefit to some degree in all alloy tempers it provides particularly a significant improvement in those product forms and tempers in which in the absence of such treatment the fracture mode would be a brittle intergrannular fracture.

Previously we had investigated the effects of a secondary ageing treatment upon 8090 plate material in the T8771 condition (that is material aged for 32 hours at 170° C.) and based on secondary ageing times of 1 hour or more at temperatures of 170° C. to 230° C. it was concluded that some slight improvement in the short transverse fracture toughness of the material could be obtained by duplex ageing. A brief mention of this conclusion is given in a paper by C. J. Peel and D. S. McDarmaid given at pages 18 to 22 in the May. 1989 issue of Aerospace, which is the journal of the Royal Aeronautical Society. The best result that had been obtained by such a secondary ageing temperature was an improvement in short transverse fracture toughness as reflected by crack propagation in the longitudinal direction (hereinafter termed S-L fracture toughness) from approximately 20.5 MPa(m)$^{\frac{1}{2}}$ to 26 MPa(m)$^{\frac{1}{2}}$ following ageing for 1 hour at 210° C. The practice used in this method is typical of that used in ageing practice in that the material was heated and cooled slowly to achieve thermal uniformity and held at temperature for an appreciable time in the expectation of securing an ageing response.

In contradistinction to our earlier result and expectation it has now been discovered that a more pronounced benefit in terms of improvement to short transverse properties can be achieved by use of a new heat treatment which is not intended to promote an ageing response and which is different in nature to those known in the art for the purposes of artificial ageing.

BRIEF DESCRIPTION OF THE DRAWINGS

The claimed invention is described below by way of example with reference to the drawings of which:

DESCRIPTION OF THE INVENTION

Figure 1:
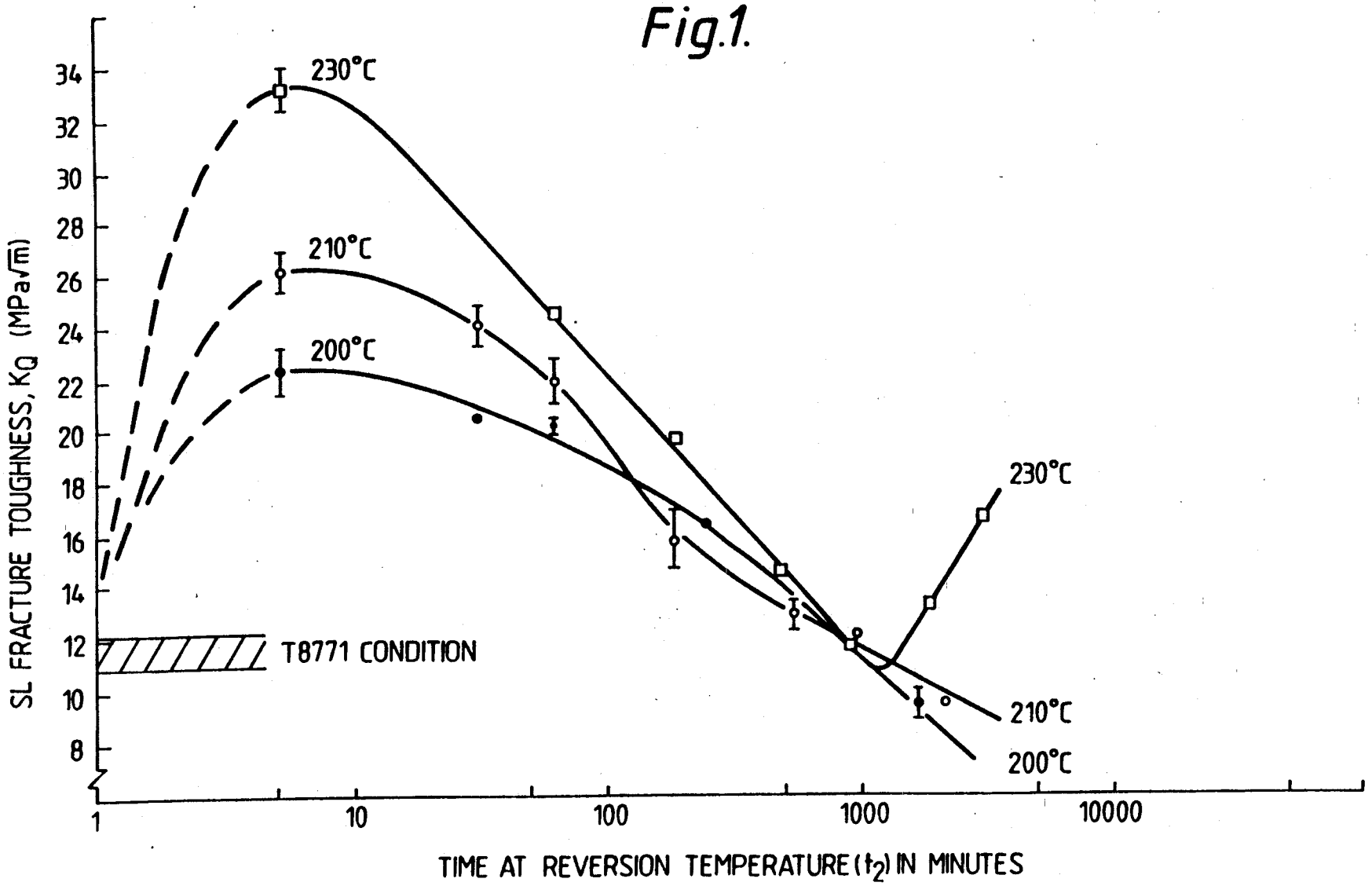
FIG. 1 is a graph showing a plot of SL fracture toughness against auxiliary heat treatment times and temperatures.

The invention claimed herein is an auxiliary heat treatment for aluminium-lithium alloy material applied at or subsequent to completion of ageing which comprises heating the material to increase its temperature steadily beyond the maximum temperature attained in its ageing, hereinafter designated "$t_1$", so that the temperature exhibited in its colder parts attains a level hereinafter termed the "reversion temperature" and designated "$t_2$", wherein the reversion temperature does not exceed 250° C. but exceeds by at least 20° C. the maximum ageing temperature, retaining the material briefly at temperature but for no more than 30 minutes to achieve thermal equilibration in the material, and immediately thereafter cooling the material towards room temperature.

The benefits of the auxiliary heat treatment are achieved through changes in temperature rather than holding at temperature in the manner of an isothermal treatment and the term "steadily" as applied to the increase in temperature achieved in the heating stage implies that there are no deliberate holds etc in raising the temperature from $t_1$ to $t_2$. It could be most convenient in foundry practice to apply the auxiliary heat treatment at the end of isothermal ageing without an intervening cooling to room temperature. The heating from $t_1$ to $t_2$ is intended to be achieved as expiditiously as possible having regard to the thermal characteristics of the plant employed for the heat treatment and the length of any equilibration hold at $t_2$ will depend of course on the mass and thickness of the material and the temperature gradients imposed during heating.

It is preferred that the material is quenched or otherwise rapidly cooled from $t_2$ to room temperature or therabouts. It is preferred also that the material is heated rapidly at least in the band between $t_1$ and $t_2$. Good results have been obtained with fast heating without fast cooling and vice versa but the best results have been obtained with fast heating followed by fast cooling. There need be no significant (if any) dwell, at the reversion temperature $t_2$ for the method is not intended to act in the manner of an isothermal ageing process. The best results to date have been obtained with no more than a nominal 5 minutes hold at $t_2$ for small test piece specimens.

The preferred range for reversion temperature $t_2$ is 200°-230° C. always subject to the proviso that $t_2$ exceeds to $t_1$ by at least 20° C.

The precise nature of the phenomenon involved in this auxiliary heat treatment is not known with certainty at present but it is believed that heating the material above its ageing temperature in a steady non-isothermal manner disturbs the equilibrium established within the material by the prior ageing causing a redistribution of grain boundary solute elements. A new equilibrium with increased grain boundary precipitation might be expected to occur if the material were to be held at the reversion temperature for an appreciable time and this condition would be no better than the original aged condition. Cooling the material prior to attainment of a new equilibrium is believed to fix the material in a metastable condition which exhibits the improved properties we have observed.

Some degree of degredation towards the original pre-treated condition has been found in materials exposed continuously to temperatures of 60° C. and above. It is predicted by extrapolation from measured values that it would take 20 years of continuous exposure at 30° C. to regress to the original condition. Reapplication of the auxiliary heat treatment has been found to restore the degraded material to its previous condition. It is anticipated that an application of a similar short auxiliary heat treatment would be effective in restoring properties of material degraded by extended natural ageing or by elevated temperature processing.

DESCRIPTION OF THE PREFERRED EMBODIMENTS

The material used in the examples of the invention described here is 8090 alloy. The compositional limits for this alloy (by weight) are as follows:- lithium 2.2 to 2.7%; copper 1.0 to 1.6%; magnesium 0.6 to 1.3%; zirconium 0.04 to 0.16%; impurities iron 0,30% maximum zinc 0.25% maximum others (chromium, silicon, manganese and titanium) 0.10 maximum each; balance aluminium.

EXAMPLE 1

The material used for this example was 8090 plate of 2 inch thickness supplied in the T8771 condition. Material in this condition has been processed as follows: solution treatment temperature 545° C.; quenched; stretched 7%; and aged for 32 hours at 170° C. From this plate various test pieces were machined suitable for measurement of fracture toughness and tensile properties in the short transverse orientation. The fracture toughness test pieces were of double cantilever beam form and such as to give a stressing orientation on the short transverse axis and crack growth on the longitudinal axis. The value of fracture toughness obtained from these test pieces is termed herein "SL fracture toughness". It is designated $K_Q$SL in accordance with normal metallurgical practice to indicate that the test methodology accords with the established rules but the crack propagation does not necessarily proceed in a manner as required for a definative value.

Some specimens of the test material were evaluated in the as-supplied condition whilst other specimens were subjected to an auxiliary heat treatment prior to testing. All tests were performed at room temperature except as otherwise stated. The auxiliary heat treatment was applied by immersion of the specimens from room temperature in a salt bath pre-heated to the required reversion temperature $t_2$. The specimens were held in the salt bath (within a furnace) until they attained the required reversion temperature as indicated by a flattening of the output of a thermocouple attached to a dummy specimen in the salt bath, held for a further five minutes in the bath at temperature, then withdrawn from the bath and quenched in cold water. Obviously the heating and cooling rates in this regime vary considerably in a non-linear manner. The overall average heating rate and cooling rate are estimated at 40° C./minute and 350° C./minute respectively. Heating and cooling in this manner are hereafter termed respectively rapid heating and rapid cooling for the purposes of comparison. The table below documents the properties of the starting material and material which has been auxiliary heat treated to the above methodology at various reversion temperatures.

| | $K_Q$(SL) MPa (m)$^{\frac{1}{2}}$ | 0.2% Proof Stress MPa | Tensile Strength MPa | % elongation to break | Reduction in area | $HV_{10}$ |
|---|---|---|---|---|---|---|
| T8771 (control) | 11.6 | 372 | 476 | 1.9 | 4.3 | 156 |
| $t_2$ = 190° C. | 18.2 | 356 | 470 | 3.7 | 8.6 | 151 |
| $t_2$ = 200° C. | 22.5 | 348 | 457 | 3.4 | 6.5 | 148 |
| $t_2$ = 210° C. | 26.0 | 340 | 447 | 3.7 | 6.25 | 142 |
| $t_2$ = 220° C. | 29.0 | 333 | 439 | 6.0 | 8.75 | 139 |

It will be seen that the auxiliary heat treatment is extremely effective in increasing the SL fracture toughness and ductility in the short transverse orientation. Some loss of short transverse strength is involved. The relative value of improvement and penalty might vary with the application for which the material is intended but it is likely that the $K_Q$SL value can be increased to the 18-20 MPa(m)$^{\frac{1}{2}}$ value of the 7000 series materials without incurring a limiting loss of strength.

The results of the auxiliary heat treatments documented above and those of other heat treatments at periods yielding isothermal ageing conditions are depicted graphically in FIG. 1. All materials documented in this graph were treated in the same rapid heat/rapid cool regime but with different treatment temperatures and times at temperatures. It will be seen that there is a pronounced peak in the curve of fracture toughness against time at temperatures which occurs in the 5 to 10 minute band and that the benefits are far below the optimum with time at temperature of one hour or more. A treatment at times typical of isothermal ageing practice impaires properties rather than improves them (insofar as reflected in $K_Q$).

Figure 2:
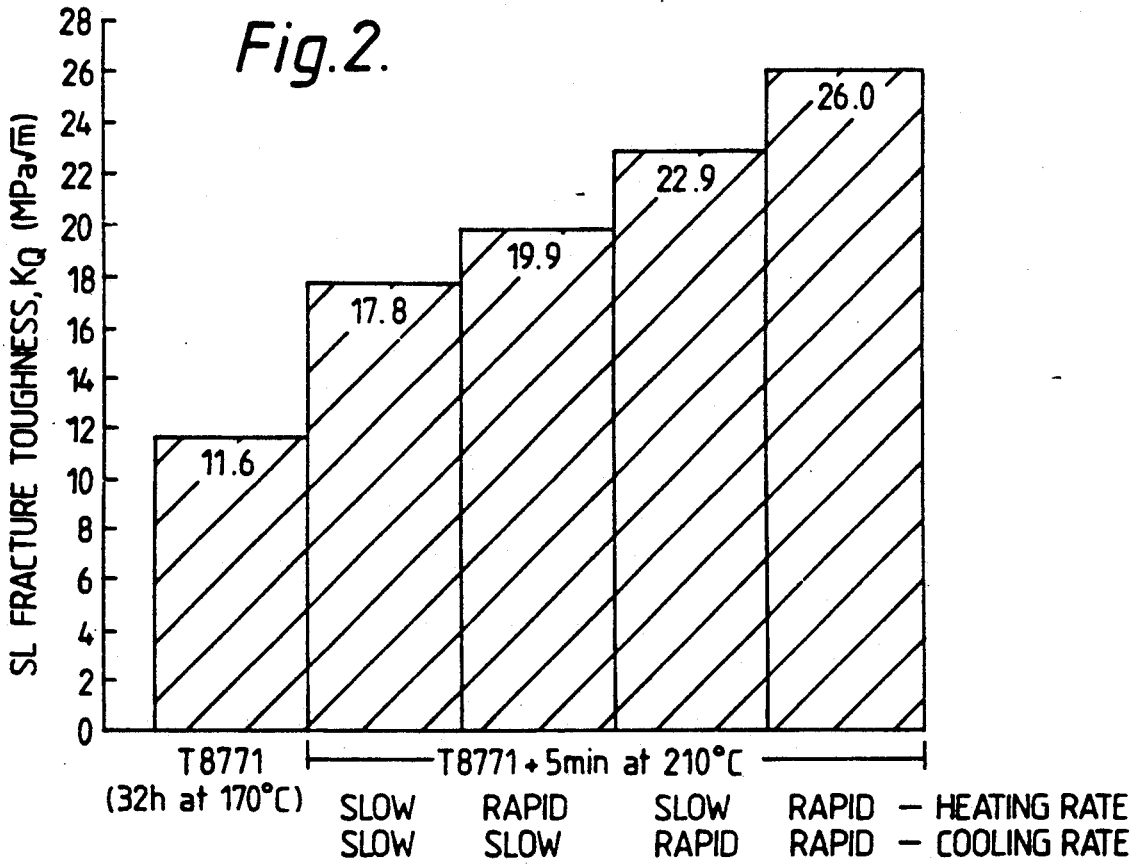
FIGS. 2 and 3 are histograms illustrating the influence of heating and cooling rates.
Figure 3:
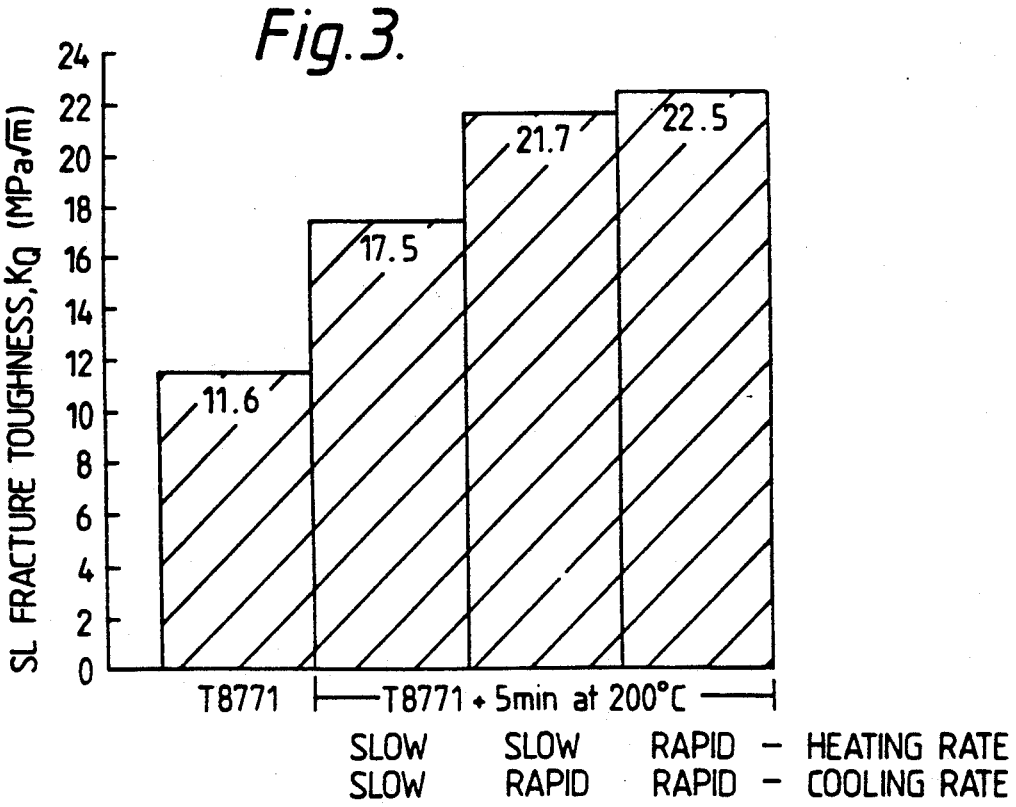

Further specimens of T8771 material have been subjected to a slightly modified form of auxiliary heat treatment which is the same as that reported above save that the treatment involved slow heating in the furnace in air and slow cooling out of the furnace in air. The estimated average rates in these slow heating and slow cooling regimes are 4° C./minute and 400° C./hour. Some specimens were subjected to rapid heating and slow cooling and other the contrary. Results for $t_2$=210° C. and $t_2$=200° C. are documented in FIGS. 2 and 3 respectively. It appears that rapid cooling is more beneficial than rapid heating and that the best results are obtained with rapid heating followed by rapid cooling. Useful improvements are still secured through the slow heating-slow cooling auxiliary heat treatment at the rates documented although whether this improvement would be sustained with prolonged heating and cooling in the manner of isothermal ageing is uncertain.

EXAMPLE 2

Figure 4:
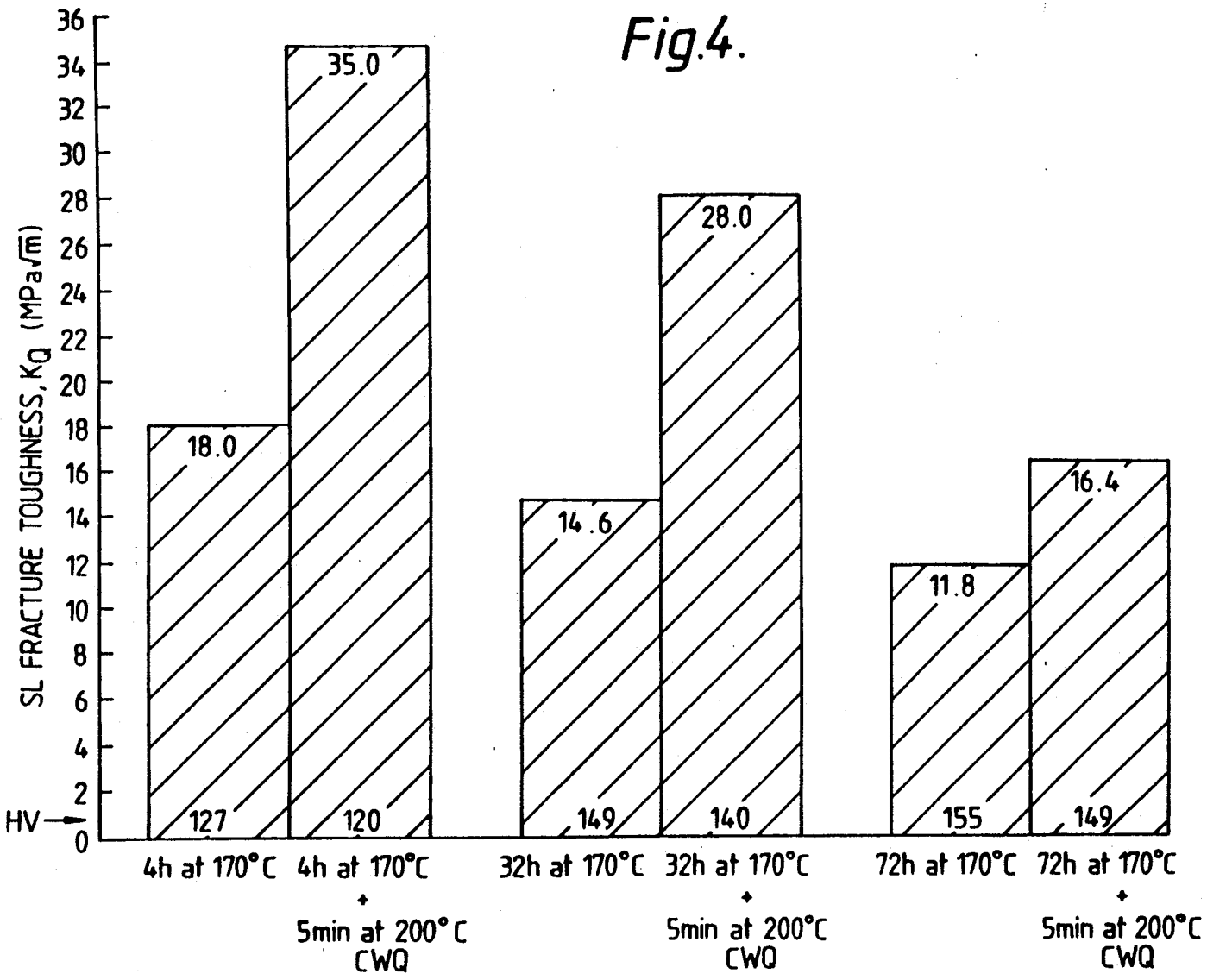
FIGS. 4 and 5 are histograms illustrating the benefit secured by means of the auxiliary heat treatment on materials pre-aged to varying standards.
Figure 5:
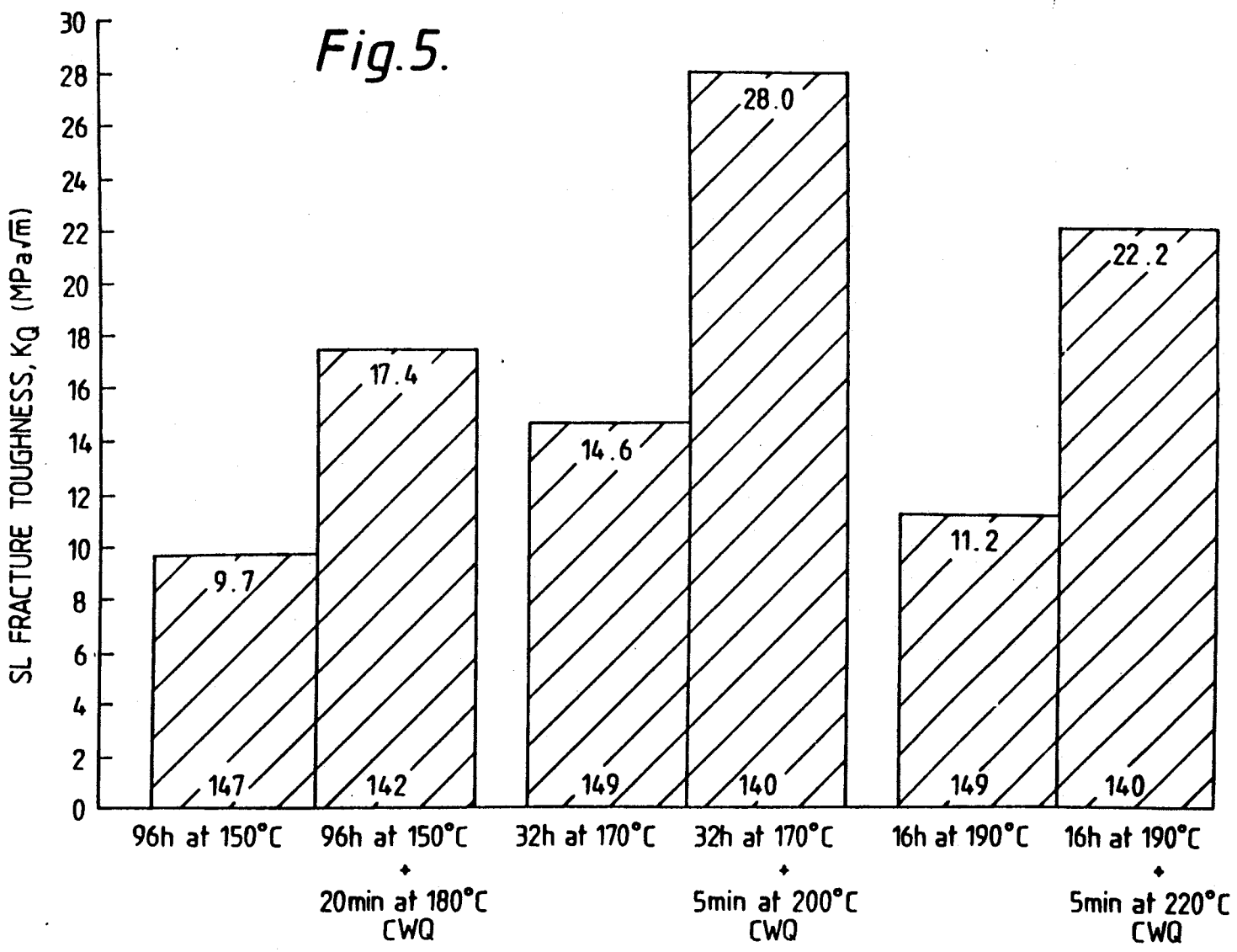

For this example unaged 8090 1 inch plate in the T351 condition was used. This material is solution treated at 535° C., quenched stretched 2½% but not aged. Using this as the starting point the material was aged at various temperatures from 150° C. to 190° C. and for various times from 4 hours to 96 hours. The artificially aged material was subjected to auxiliary heat treatments comprising various reversion temperatures and times at temperature. The results are documented in FIGS. 4 and 5. It will be seen that in all cases the auxiliary heat treatment secures very significant improvement in the SL fracture toughness.

We claim:

1. An auxiliary heat treatment for aluminium-lithium alloy material applied at or subsequent to completion of ageing which comprises heating the material to increase its temperature steadily beyond the maximum temperature attained in its ageing so that the temperature exhibited in its colder parts attains a level termed the reversion temperature wherein the reversion temperature does not exceed 250° C. but exceeds by at least 20° C. the maximum ageing temperature, retaining the material at the reversion temperature for no more than 30 minutes to achieve thermal equilibration in the material, and immediately thereafter cooling the material towards room temperature.

2. Auxiliary heat treatment as claimed in claim 1 in which the material is quench cooled to room temperature or thereabouts.

3. An auxiliary heat treatment as claimed in claim 1 in which the material is rapidly heated to the reversion temperature from at least the maximum ageing temperature.

4. An auxiliary heat treatment as claimed in claim 1 in which the material is held at the reversion temperature between the heat up and the cooling down for a period of five to twenty minutes.

5. An auxiliary heat treatment as claimed in claim 1 in which the reversion temperature is within the range 190° to 230° C.

6. A material or product thereof comprising an alloy of the aluminium-lithium-copper-magnesium system having improved fracture toughness in short transverse direction up to 34 mPa(m)$^{\frac{1}{2}}$ having been artificially aged and then subjected to an auxiliary heat treatment as claimed in claim 1.

7. A material or product thereof as claimed in claim 6 comprising an alloy with a composition within that specified for the registered alloy 8090 and in which the auxiliary heat treatment comprises a rapid heat up to a reversion temperature in the range 190° to 230° C., a hold at reversion temperature for about 5 minutes, and a rapid cool down to room temperature or thereabouts.

* * * * *